US005273197A

United States Patent [19]

Wenk

[11] Patent Number: 5,273,197

[45] Date of Patent: Dec. 28, 1993

[54] ROLLER FOR GUIDING AND STRETCHING BANDS AND FILM WEBS

[75] Inventor: Karl-Heinrich Wenk, Bad Nauheim, Fed. Rep. of Germany

[73] Assignee: Leybold Aktiengesellschaft, Hanau, Fed. Rep. of Germany

[21] Appl. No.: 768,152

[22] Filed: Sep. 30, 1991

[30] Foreign Application Priority Data

Aug. 10, 1991 [DE] Fed. Rep. of Germany ..... 4126535

[51] Int. Cl.[5] ..... B65H 20/00; D06C 3/06

[52] U.S. Cl. ..... 226/190; 26/99

[58] Field of Search ..... 242/76, 56.5; 226/190, 226/194; 26/99, 100; 29/121.1, 121.5, 125

[56] References Cited

U.S. PATENT DOCUMENTS

| | | | |
|---|---|---|---|
| 479,501 | 7/1892 | Goddard | 26/100 |
| 3,392,431 | 7/1968 | Bisang | 26/99 |
| 3,848,304 | 11/1974 | Lucas | 29/116 AD |

FOREIGN PATENT DOCUMENTS

| | | | |
|---|---|---|---|
| 892286 | 10/1953 | Fed. Rep. of Germany . | |
| 1019902 | 4/1958 | Fed. Rep. of Germany . | |
| 1073292 | 1/1960 | Fed. Rep. of Germany . | |
| 1802476 | 4/1970 | Fed. Rep. of Germany | 242/76 |
| 2638903 | 4/1977 | Fed. Rep. of Germany . | |
| 3338965 | 5/1985 | Fed. Rep. of Germany . | |
| 3733448 | 3/1989 | Fed. Rep. of Germany | 26/100 |
| 4025232.9 | 8/1990 | Fed. Rep. of Germany . | |
| 3922945 | 1/1991 | Fed. Rep. of Germany | 242/76 |
| 7207520 | 12/1973 | France . | |
| 593192 | 11/1977 | Switzerland . | |
| 11654 | of 1907 | United Kingdom | 26/99 |
| 1333076 | 10/1973 | United Kingdom | 26/100 |

*Primary Examiner*—Daniel P. Stodola
*Assistant Examiner*—John Rollins
*Attorney, Agent, or Firm*—Felfe & Lynch

[57] ABSTRACT

In a roller for guiding and stretching bands and/or film webs (21) for winding apparatus (FIG. 1), preferably for apparatus for the continuous vacuum vapor depositing or sputtering of plastic webs with a plurality of external drums (2) of identical configuration disposed side by side on the roller shaft (4) held in the manner of roller bearings for rotation on ball bearings (10), in which the external drums are held apart from one another without touching, and the film band or the film web (21) wraps partly around and at the same time lies with bias against portions of the cylindrical circumferential surface of the external drums, at least one profile bar (18) is held and guided longitudinally in a longitudinal groove (17) in the roller shaft (4), which cooperates with at least one ball-end pin (19) which is held in the drum mounting ring (8) associated with the external drum (2) and reaches radially downward into a recess (26) which is disposed on the profile bar (18), wherein a longitudinal displacement of the profile bar (18) turns the drum mounting rings (8) swivelingly mounted on the roller shaft (4), with respect to the longitudinal axis of the roller shaft (4).

7 Claims, 5 Drawing Sheets

ROLLER FOR GUIDING AND STRETCHING BANDS AND FILM WEBS

Figure 1:
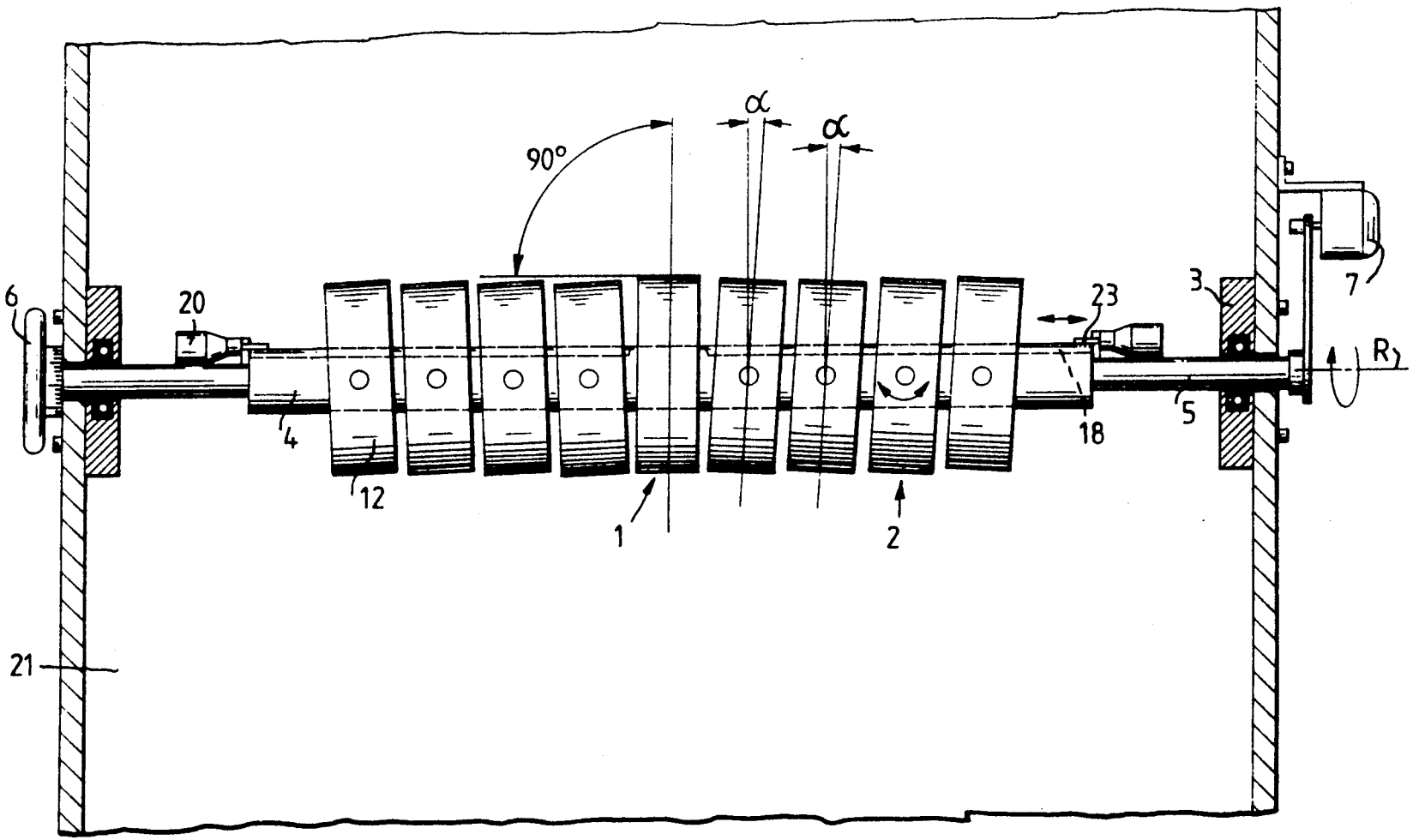

The invention relates to a roller for guiding and stretching bands and/or film webs for winding apparatus, preferably for apparatus for continuous vacuum depositing or sputter coating of plastic or paper bands and webs, with a plurality of external drums of identical configuration disposed side by side on the roller shaft held in the manner of roller bearings for rotation on ball bearings, the external drums being held apart from one another without touching, and the film band or the film web wrapping partly around and at the same time lying with bias against portions of the cylindrical circumferential surface of the external drums. A stretching and contracting roller for sheets or webs of flexible material is known (DE-PS 892,286) which has a curved portion between the end sections and which—with the arched axis of the roller adjustable in any desired planes—can be clamped tight. Such stretching and contracting rollers are provided with an elastic tube of textile material which is drawn over the individual roller drums and thus provides for a continual running of the roller drums. This known roller has the disadvantage, among others, that experience shows that it takes on a strong electrostatic charge, which is unacceptable in a winding system for a sputtering apparatus.

A roller has already been proposed (DE-P 40 25 232.9) for guiding and stretching bands and/or film webs for winding systems, preferably for apparatus for the continuous vacuum coating or sputter-coating of plastic bands and webs, in which a plurality of external drums of identical configuration disposed side by side on the roller shaft and rotatable on the shaft on roller or ball bearings in the manner of axial cylindrical roller bearings, the external drums being held apart from one another without touching, and the film band or film web partially wrapping around the external drums and at the same time contacting with bias portions of the cylindrical circumference of the external drums.

The present invention is addressed to the problem of creating a roller of the type in question, which is cheap to manufacture, whose synchronous running is especially precise, which produces little noise, which permits high rotatory speeds while avoiding any special lubricating system, and which retains its characteristics even under the conditions of a high vacuum, i.e., for example contains no parts consisting of materials which tend to outgas and thus to become brittle. Furthermore, depending on the type and nature of the film, either the entire roller and/or the drums cooperating directly with the film are to be adjustable during operation, so that the film can be drawn straight and smooth at all times.

This problem is solved according to the invention by at least one profile bar held and guided longitudinally in a longitudinal groove in the roller shaft, which cooperates with studs or ball-end pins which are held in the drum mounting rings associated with the external drums or are made in one piece with the latter, while a longitudinal displacement of the profile bar turns the drum mounting rings swivelingly mounted on the roller shaft, with respect to the longitudinal axis of the roller shaft.

Therefore the rings disposed on the roller shaft on the right and left of the center are journaled so as to pivot transversely of the shaft axis. These swivelingly mounted rings are adjustable in their angle to the longitudinal axis of the roller such that spreading or stretching can be achieved depending on the film quality.

The gap between the individual drums or rings is best selected so that it will not affect the spreading action. Moreover, with this straight spreader roller, which has no arcuate belly, the distance to the next roller can be very small, which again leads to taking up less space.

Additional details and features are explained and identified in the claims.

Figure 2:
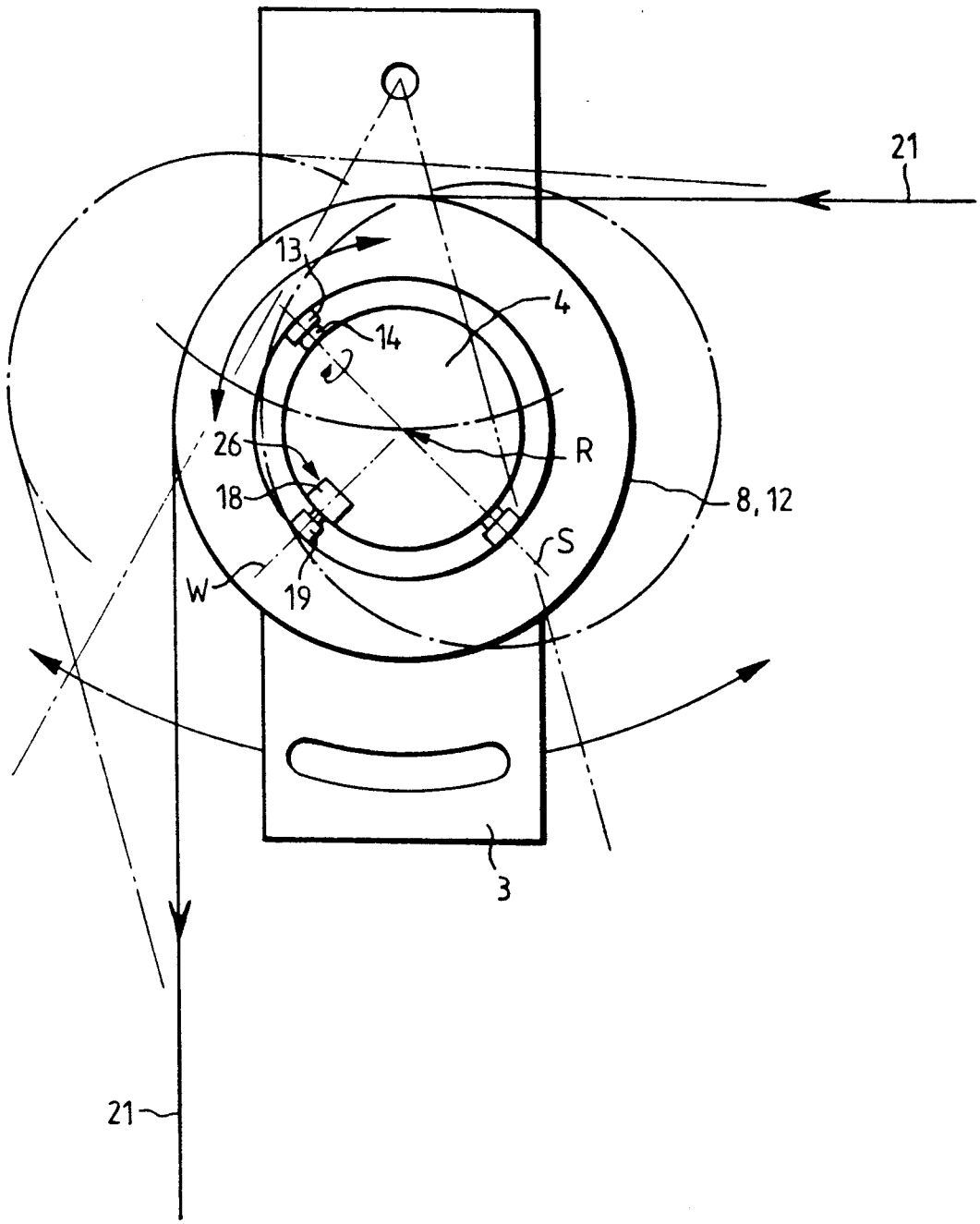
Figure 3:
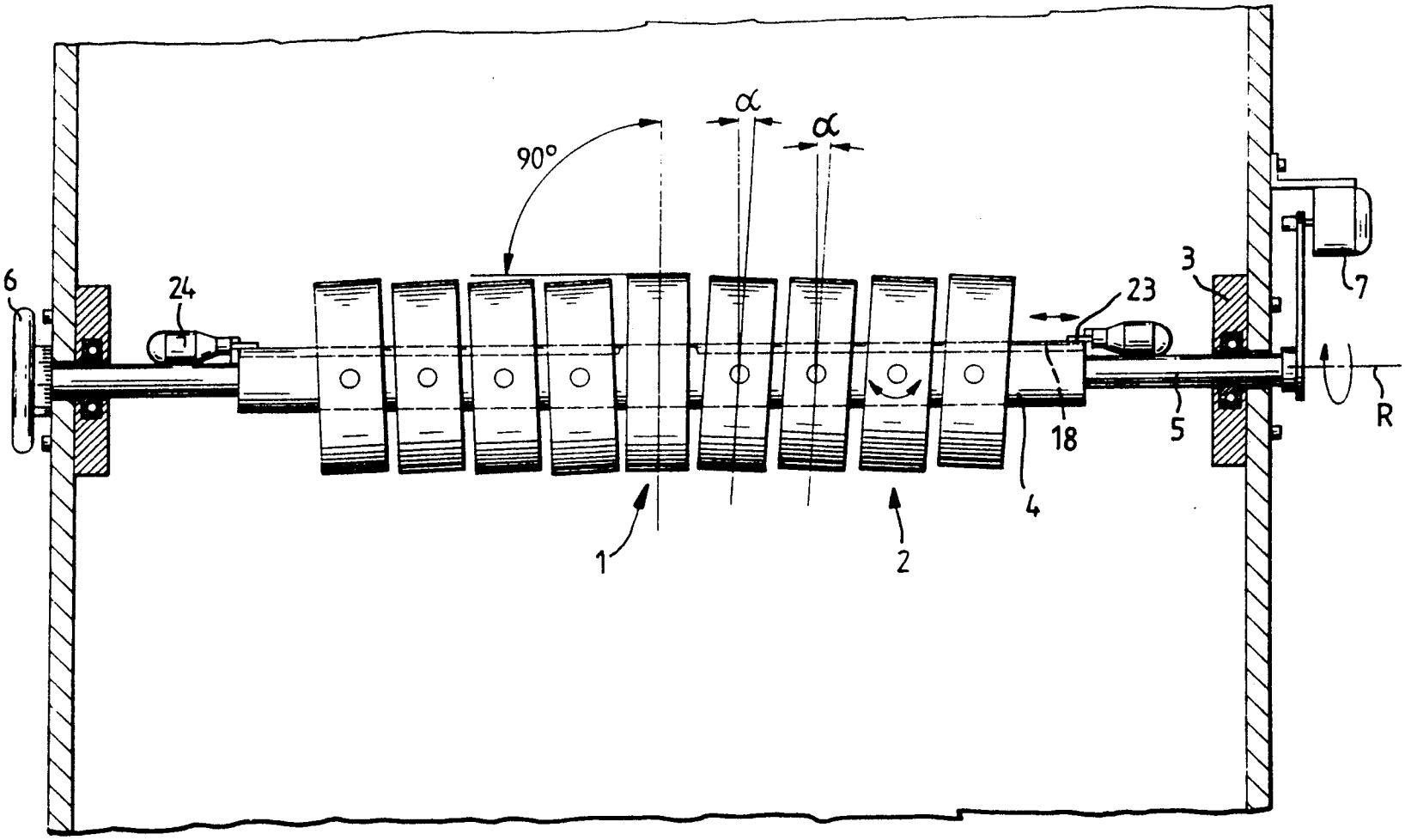
Figure 4:
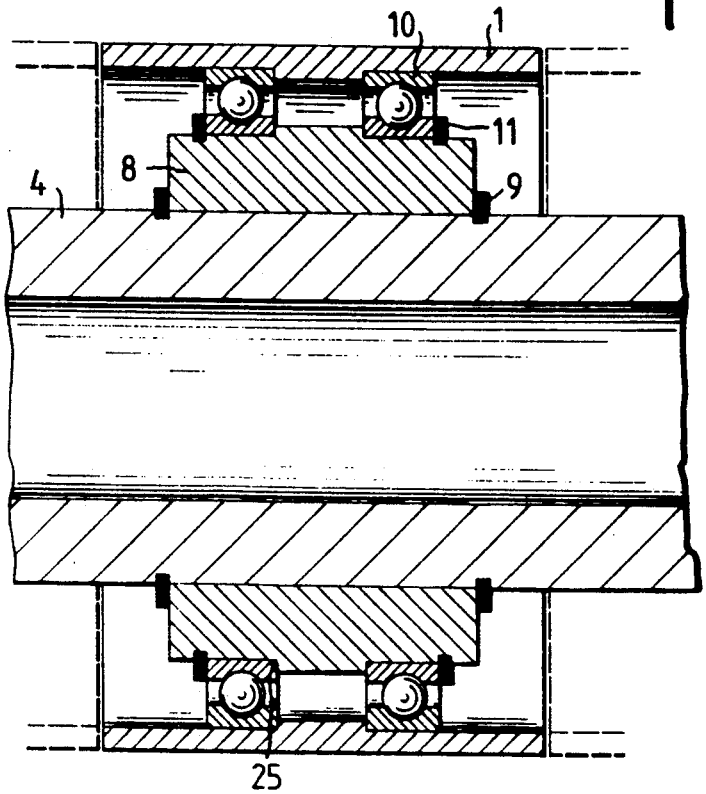
Figure 5:
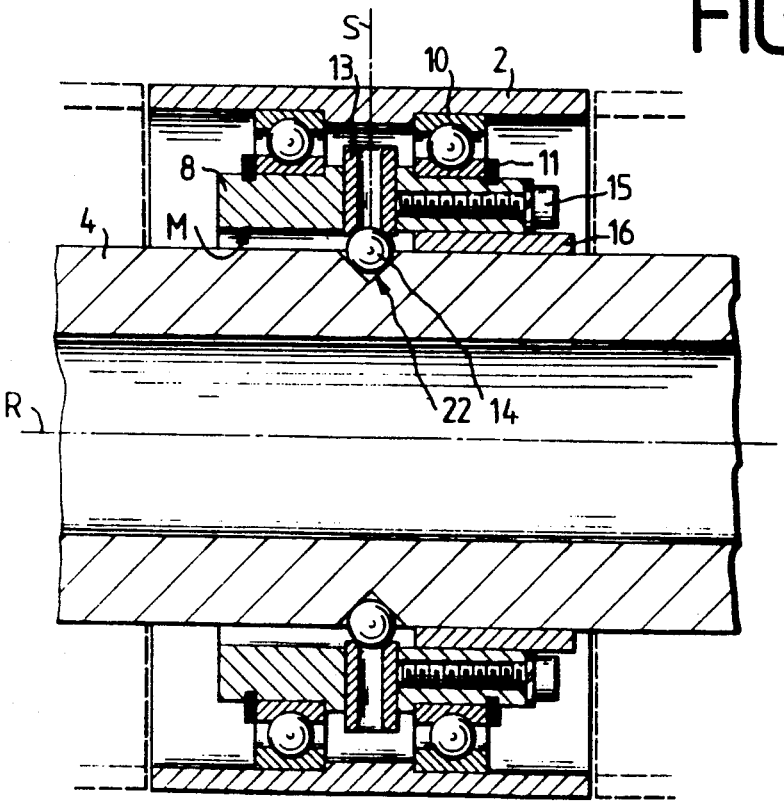
Figure 6:
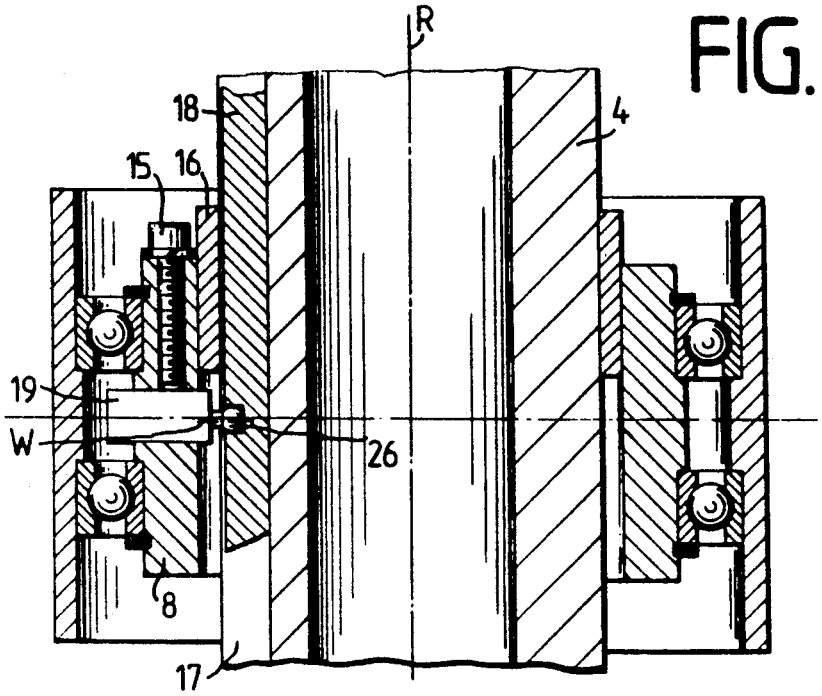
Figure 7:
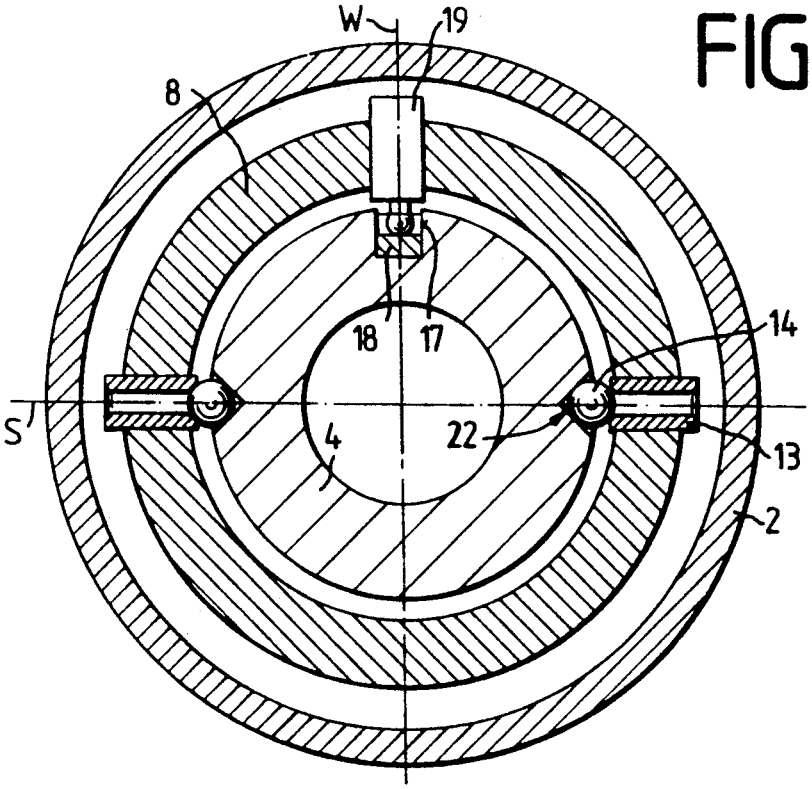

The invention admits of a great variety of embodiments; one of them is represented diagrammatically in the appended drawings, wherein:

FIG. 1 is a side view of the straight, adjustable-angle, metal spreader roller with manual adjustment of the drums, with mounting and hand wheel (or motor-driven adjustment of the wrap-around angle), FIG. 2 shows the wrap-around and adjustability of the spreader roller in section and in a purely geometric manner, FIG. 3 is a side view of the straight, adjustable-angle, metal spreader roller of FIG. 1, but with motor-driven adjustment of the drums and rings, as well as its mounting, FIG. 4 is an enlarged longitudinal section of the middle, non-swiveling drum and non-swiveling ring, FIG. 5 is an enlarged longitudinal section of a swiveling drum and ring, FIG. 6 is a longitudinal section of part of the adjusting system for swiveling the rings, and FIG. 7 is a cross section of the adjusting system of FIG. 6.

The straight metal, adjustable-angle spreader roll is divided into revolving segments or drums 2, the central, nonswiveling drum 1 being always square with or at right angles to the center of the web. The other, swiveling drums 2 are disposed on the right or left of the web center such that they are continually at a specific angle to the central axis or web line.

One possible variant of this system is for some of the drums 2 to be set at a smaller angle from the center out and the margin drums 2 to swivel more greatly in their angularity at the two ends of the roll shaft 4.

The turning (variation of the angle) of the swiveling drums 2 is brought about by a displaceable profile bar 18 disposed one on the left and one on the right of the center, each held in a groove 17.

To be able to perform a very precise adjustment of the angle, there is at the end of each displaceable profile bar 18 an adjusting drive 20 with a rotatable spindle and a pitch of, for example, 0.5 mm, and with an additional locking device.

The adjusting drive 20 is affixed on the one hand to the main shaft 4, and on the other hand it is clamped to the two displaceable profile bars. Before the drums are installed, attention must be given to setting the adjusting drive at zero and locking it. The accuracy of angular adjustment of the drums can, in this arrangement, amount to approximately 0.2 degrees per quarter turn of the adjusting drive.

In case it is desired to make an initial change in the angle of the outwardly turned end drums 2, the drive must be given a negative setting before installation.

This manual adjustable-angle metal spreader roller is mounted on two adjustable bearing plates 3 which hold the ends 5 of the main shaft 4 and which in turn are fastened pivotally on the machine frame so as to achieve a change in the wrap-around angle.

In order further to achieve the correct spreading point for the spreading roll, either a calibrated hand wheel 6 with lock is provided, or a motor 7 for changing the wrap-around angle.

The nonswiveling center drum according to FIG. 4 consists of a drum mounting ring 8 which is fixedly fastened to the mounting shaft 4 by means of snap rings 9. Also, two ball bearings 10 are disposed on the drum mounting ring 8, which are fastened with snap rings 11. Before installing these bearings, care must be taken that the bearings 10 are first exhausted of air to prevent grease from escaping from the annular space between the bearings 10 during the 10 air evacuation process. On the outer ring of the ball bearings 10 is the outer drum 12, which is held due to its special geometry by the two ball bearings 10. Due to this geometry of the drum 12 and due to the shoulders 25, imbalance is virtually impossible (rotationally symmetrical part).

The other drums 2 mounted on either side of the central, nonswiveling drum 1 (FIG. 5) are all mounted on the main shaft 4 so as to be able to swivel.

In detail, each drum consists of a drum mounting ring 8, which are journaled clearance-free by means of two bushings 13 and two balls 14 in indentations 22 in the main shaft 4. These bushings 13 are fixed by screws 15 in the drum mounting ring 8.

In order to achieve always the same spacing between the drum mounting ring 8 and the main shaft 4, when these components are installed, a sleeve 16 is inserted between them as an aid in assembly. Furthermore, two ball bearings 10 are mounted on the mounting shaft 8 and fastened with snap rings 11. On the outer ring of the ball bearing 10 is the film steering drum 2 which due to its special geometry is held in place by the two ball bearings.

For the adjustment of the drums, according to FIG. 6 a groove 17 is created in the main shaft 4 such that it is located precisely in the middle of the two bearings 13, 14. Rectangular profile bars 18 are displaceably inserted into this groove 17 on the right and left of the center of the main shaft 4. In the rectangular profile bars 18, on the centers of the swiveling drums, notches are provided in which the spherically shaped heads of the ball-end pins 19 carried in the drum mounting ring 8 are held without clearance.

The ball-end pins 19 are held tightly in the drum mounting rings 8 by means of threaded spindles 15. To avoid needing very great accuracy in the spacing of the notches in the rectangular bars 18, the ball pins have a slight excentricity of about 1 millimeter. In the installation of these ball pins the zero or 90-degree setting of the rings 8 is assured again by means of an installation sleeve 16, the two rectangular profile bars 18 being first fixed tightly in their zero position.

In the case of the metal spreader roller with the motorized angular adjustment according to FIG. 3, the only difference between it and the embodiment according to FIG. 1 is that the manually adjustable micrometer drive 20 is replaced by a stepping motor 7 which moves the rectangular profile bar or profile bars 18 in small steps, preferably by means of a pinion and a rack 23, thus producing the angular adjustment.

I claim:

1. A roller for guiding and stretching bands and/or film webs for winding apparatus, comprising: a plurality of external drums of identical configuration disposed end to end about the roller axis and held for rotation on rolling bearings about the roller axis, the external drums having cylindrical surfaces and being held apart from one another, and a film band or film web passing partially around the external drums and at the same time being biased against portions of the cylindrical surfaces of the external drums, a roller shaft having a longitudinal groove on an outer surface thereof at least one profile bar held and guided for longitudinal displacement in the longitudinal groove in the roller shaft, a plurality of drum mounting rings pivotally mounted on said roller shaft, a drum mounting ring holding at least one pin which cooperates with the at least one profile bar, and wherein said at least one pin extends radially inward into a notch which is disposed on the profile bar, while a longitudinal displacement of the profile bar swivels the drum mounting rings with respect to the longitudinal axis of the roller shaft, the drum mounting rings being held on the roller shaft pivotingly each by a pair of pins.

2. A roller according to claim 1, characterized in that the drum mounting ring has two bearing means situated diametrically opposite one another, which extend radially inwardly into corresponding indentations which are provided in the roller shaft, and thus permit the drum mounting ring to perform a swiveling movement with respect to the roller shaft.

3. A roller according to claim 2, characterized in that the bearing means are formed in each case by a bushing and a ball supporting it, the ball extending on the other hand into a recess in the shaft, and thus forming with the latter a swivel bearing.

4. A roller according to claim 1, characterized in that the profile bar has on its one end teeth which cooperate with a worm drive of a motor which is fixedly disposed on the shaft such that the profile bar is longitudinally displaceable by rotating the worm drive for the purpose of swiveling the drums with respect to the shaft.

5. A roller according to claim 1, characterized in that the drum mounting ring is held apart from two adjacent external drums by snap rings on the roller shaft.

6. A roller according to claim 1, characterized in that the drum mounting ring has two fingers extending radially inward, which are disposed at more or less diametrically opposite points of a radially interior surface of the drum mounting ring and, together with indentations, recesses or blind holes in the circumference of the roller shaft, form a turning or tilting bearing about which the drum mounting ring and thus also the external drum mounted rotatably on it are tiltable or swingable relative to the roller axis, while a swivel axis running through said two fingers is disposed more or less perpendicular to the axis of rotation of the roller shaft.

7. A roller according to claim 1, characterized in that the drum mounting ring has a finger extending radially inward from an inside surface, which cooperates with an abutment which is disposed on a profile bar displaceably disposed on the roller axis parallel to an axis of rotation, an effective axis which runs through the finger being approximately perpendicular on the axis of rotation and also being more or less perpendicular on a swivel axis.

* * * * *